US006873311B2

(12) United States Patent
Yoshihara et al.

(10) Patent No.: US 6,873,311 B2
(45) Date of Patent: Mar. 29, 2005

(54) LIQUID CRYSTAL DISPLAY UNIT AND DISPLAY CONTROL METHOD THEREFOR

(75) Inventors: Toshiaki Yoshihara, Kanagawa (JP); Akihiro Mochizuki, Kanagawa (JP); Hironori Shiroto, Kanagawa (JP); Tetsuya Makino, Kanagawa (JP); Yoshinori Kiyota, Kanagawa (JP)

(73) Assignee: Fujitsu Limited, Kawasaki (JP)

( * ) Notice: Subject to any disclaimer, the term of this patent is extended or adjusted under 35 U.S.C. 154(b) by 328 days.

(21) Appl. No.: 09/044,421

(22) Filed: Mar. 19, 1998

(65) Prior Publication Data

US 2002/0000960 A1 Jan. 3, 2002

(30) Foreign Application Priority Data

Oct. 14, 1997 (JP) ..... 9-280616

(51) Int. Cl.[7] ..... G09G 3/36

(52) U.S. Cl. ..... 345/87; 345/102; 345/103; 345/94; 345/96

(58) Field of Search ..... 345/87–89, 102–103, 345/94–96

(56) References Cited

U.S. PATENT DOCUMENTS 5,359,345 A * 10/1994 Hunter ..... 345/102
5,428,366 A * 6/1995 Eichenlaub ..... 345/102
5,461,397 A * 10/1995 Zhang et al. ..... 345/102
5,731,794 A * 3/1998 Miyazawa ..... 345/102
5,751,261 A * 5/1998 Zavracky et al. ..... 345/99
5,760,758 A * 6/1998 Seike et al. ..... 345/95
5,877,739 A * 3/1999 Kanbe et al. ..... 345/94

* cited by examiner

*Primary Examiner*—Regina Liang
*Assistant Examiner*—Duc Q. Dinh
(74) *Attorney, Agent, or Firm*—Greer, Burns & Crain, Ltd.

(57) ABSTRACT

A liquid crystal display unit includes a liquid crystal panel having a plurality of liquid crystal pixels and a plurality of switching elements provided in correspondence to the respective pixels. A back light disposed at the back of the liquid crystal panel and guides red, green, and blue light to the surface thereof; an image memory for storing pixel data PD to be displayed on the respective pixels; an inverted data generating circuit for generating inverted pixel data #PD of the respective pixel data PD; and a control signal generating circuit and a data driver wherein first scanning for writing the pixel data PD with respect to individual pixels of the liquid crystal panel during each period in which red, green, and blue light are emitted in time-sharing manner, and second scanning for writing the inverted pixel data #PD with respect thereto are carried out in this order. Such problems that crosstalk occurs easily, besides response speed thereof is comparatively slow, so that it is not suitable for display of moving picture despite manufacturing cost of STN type display unit is comparatively inexpensive, while because TFT-TN type display unit requires a highly luminous back light, its power consumption is high, viewing angle is narrow, adjustment is difficult in color balance and the like are solved.

15 Claims, 13 Drawing Sheets

1,5:POLARIZING FILM
2,4:GLASS SUBSTRATE
3:COMMON ELECTRODE
6:LIGHT GUIDING PLATE + LIGHT DIFFUSION PLATE
7:LED ARRAY 11,12:ORIENTATION FILM
13:LIQUID CRYSTAL LAYER
14:SPACER
21:LIQUID CRYSTAL PANEL
22:BACK LIGHT
40:PIXEL ELECTRODE

1 FRAME (16.6ms)
R SUB-FRAME (5.6ms)
G SUB-FRAME (5.6ms)
B SUB-FRAME (5.6ms)
R SUB-FRAME (5.6ms)
G SUB-FRAME (5.6ms)
B SUB-FRAME (5.6ms)
R
G
B
R
G
B
R
G
B

FIG. 8
(a)
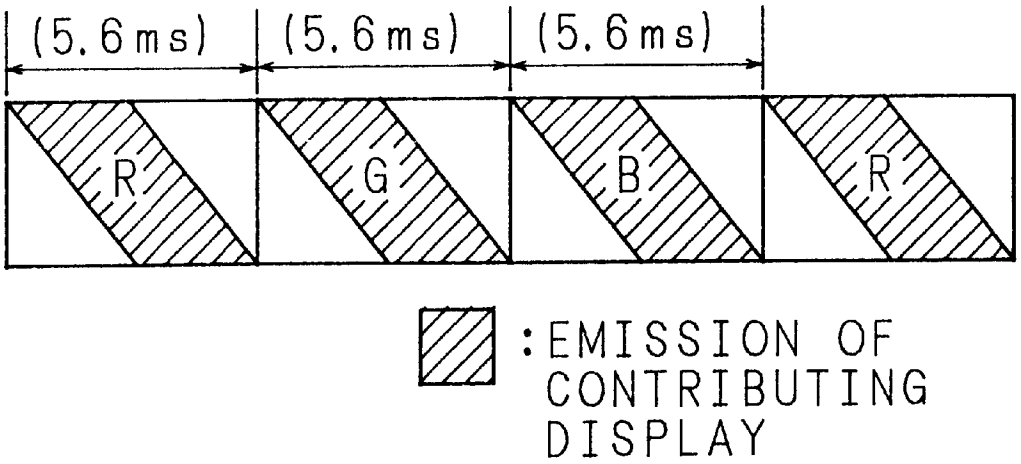
(b)
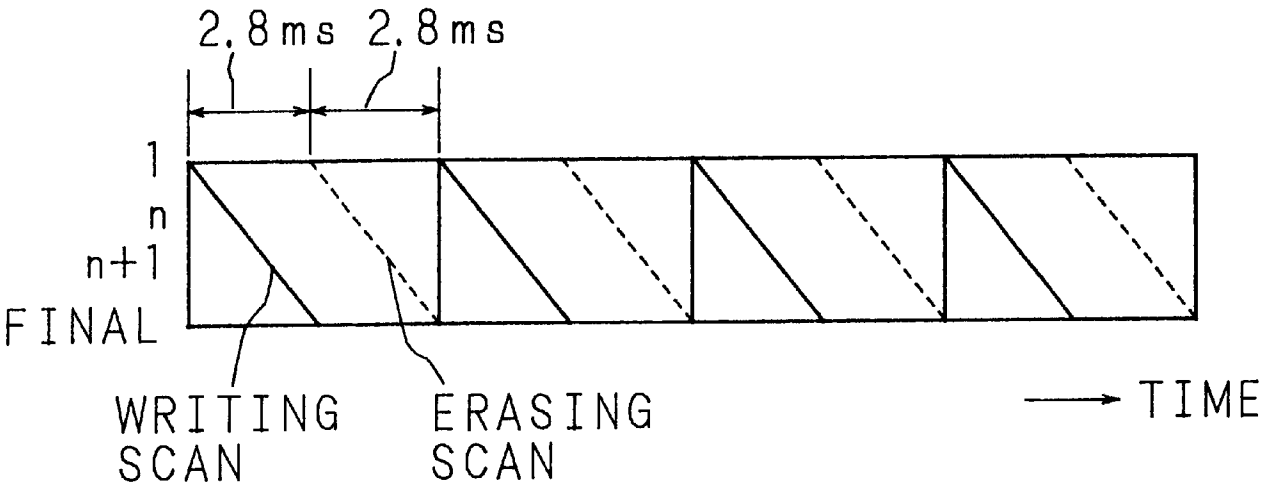

FIG. 10
(a)
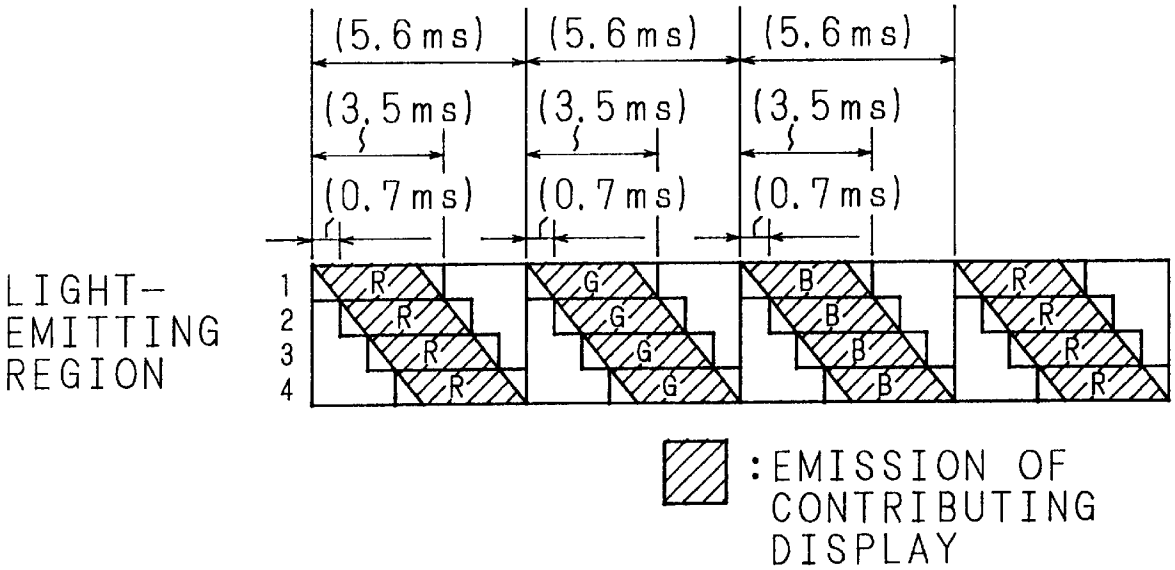
(b)
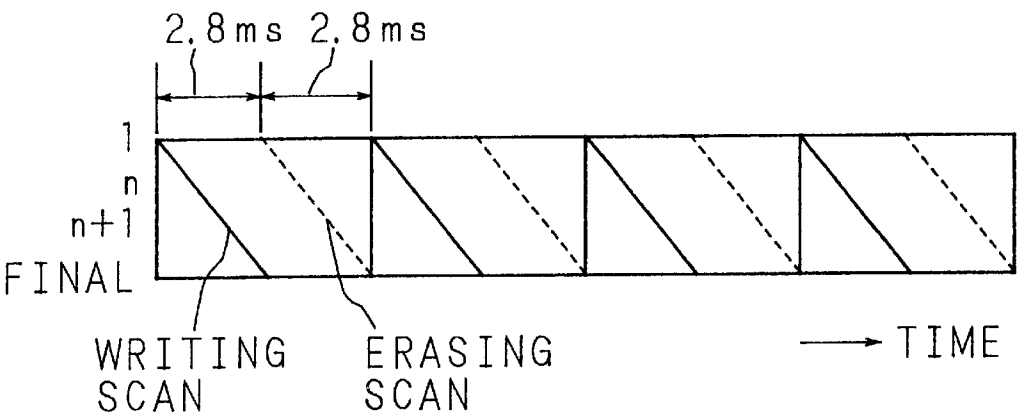

(a)

(b)

(c)

LIQUID CRYSTAL DISPLAY UNIT AND DISPLAY CONTROL METHOD THEREFOR

BACKGROUND OF THE INVENTION

The present invention relates to a liquid crystal display unit and a display control method therefor, and more particularly to a color light source type liquid crystal display unit which performs full-colored display by allowing a back light of three primary colors to emit light in time-sharing manner and the display control method therefor.

Recently, with the developments of so-called office automation, OA equipment represented by word processors, personal computers and the like have been widely employed. Furthermore, as a result of spread of such OA equipment in offices, there is a demand for transportable OA equipment which can be used in both offices and the outdoors, so that size and weight reductions of them are desired. As a means for attaining such purpose, liquid crystal display unit has been widely used. Particularly, liquid crystal display unit is indispensable technical means for realizing low power consumption in transportable type OA equipment driven by battery, but not for merely in size and weight reductions for OA equipment.

Meanwhile, liquid crystal display unit is generally classified into reflection type and transmission type display unit. Reflection type liquid crystal display unit has a structure wherein the light rays inputted from the surface of a liquid crystal panel is reflected by the bottom surface thereof to recognize visually an image, while transmission type display panel has a structure wherein an image is recognized visually by transmitted light from a light source (back light) disposed on the bottom surface of the liquid crystal panel. Since an amount of reflected light is variable in reflection type display panel according to environmental conditions, it is inferior in visual recognition, but because of its low cost, it has been widely spread as monochrome (for example, black/white display and the like) display unit for pocket calculator, timepiece and the like. However, such reflection type liquid crystal panel is not suitable for use in personal computer and the like by which multi-colored or full-colored display is carried out. For this reason, transmission type liquid crystal display unit is generally used for a display unit in personal computer by which multi-colored or full-colored display is realized.

On one hand, the existing color liquid crystal display unit is generally classified into STN (Super Twisted Nematic) type display unit and TFT-TN (Thin Film Transistor-Twisted Nematic) type display unit in view of a liquid crystal material to be used. Although manufacturing cost of STN type display unit is comparatively inexpensive, since crosstalk occurs easily in this type of display unit, besides response speed thereof is comparatively slow, there is such a problem that it is not suitable for display of moving picture. On the other hand, TFT-TN type display unit has higher quality in its display quality than that of STN type display unit, but the former requires highly luminous back light, because transmittivity of liquid crystal panel is only around 4% in the existing circumstances. For this reason, power consumption due to back light increases in TFT-TN type display unit, so that there is a problem in use thereof in transportable type OA equipment which is driven by battery power source. In addition, TFT-TN type display unit involves problems of slow response speed, particularly slow response speed in gray-scale, narrow viewing angle, difficult adjustment in color balance and the like.

Moreover, in conventional transmission type liquid crystal display units, a color filter type display unit having such structure that a back light of white light is utilized, and the white light is selectively transmitted by the use of a color filter of three primary colors, whereby multi-colored or full-colored display is made has been generally employed. In such color filter type display unit, however, since display pixels are composed by scopes of adjacent three color filters as a unit, the resolution thereof decreases to ⅓ in reality.

As mentioned above, in conventional liquid crystal display units, particularly color liquid crystal display units, although STN type display unit is comparatively inexpensive, it involves problems of easy occurrence of crosstalk, comparatively slow speed in response speed, resulting in unsuitableness for moving display and the like, while TFT-TN type display unit involves problems of high power consumption, slow response speed, particularly that in gray-scale, narrow viewing angle, difficult to maintain color balance and the like, because of requirement for high luminous back light.

BRIEF SUMMARY OF THE INVENTION

The present invention has been made in view of the circumstances as mentioned above, and an object of the present invention is to provide a color liquid crystal display unit which is excellent in particularly response speed and viewing angle characteristics, and color balance of which is variable.

A further object of the present invention is to solve such problem involved in time-shared color liquid crystal displays that substantially half of light-emitting period of time in back light is not utilized, so that it is wasteful in view of efficiency and power consumption.

In view of the above, in the liquid crystal display unit and the display control method therefor according to the present invention, a liquid crystal panel wherein a ferroelectric liquid crystal or the like by which response in the order of several hundreds sec. to several μsec. is possible is combined with a back light by which light emission of red, green, and blue is possible in a time-sharing manner, and switching of the liquid crystal is synchronized with light emission of the back light thereby performing color display. In this case, writing scan for data with respect to the ferroelectric liquid crystal panel is carried out twice during sub-frame periods for emitting respective colors of red, green, and blue light. In this case, however, the first writing scan is carried out so as to display an image, while the second writing scan is made so as to erase a display state of the image.

Furthermore, the above described control is carried out in such a manner that a certain electric field is applied to the respective pixels in the liquid crystal panel in the first writing scan, while an electric field having the same intensity as that of the former electric field and having a reverse polarity to that of the former is applied to the respective pixels in the second writing scan of data.

Moreover, at the time of second writing scan, a liquid crystal panel is constituted in such that a direction along the molecular major axes (optical axis) of substantially all the ferroelectric liquid crystal molecules is coincident with either polarization axis of two polarizing films being disposed in such a manner that both the polarization axes intersect with each other to sandwich the panel in the case when a voltage is applied to the respective pixels in the liquid crystal panel. Otherwise the polarity of a voltage to be applied to the respective pixels is optimized so as to realize such condition as described above. As a result, leakage of light beam from the back light during a period of time wherein respective pixels are in an undisplayed state is reduced.

Furthermore, in the liquid crystal display unit and the display control method therefor according to the present invention, a light-emitting region of the back light is divided into at least two light-emitting regions, and switching of light emission and extinguishment thereof is carried out in synchronous with scanning of writing scanning/erasing scanning of pixel data with respect to the liquid crystal panel. Thus, a period of time wherein the back light emits wastefully light is reduced to decrease power consumption.

Still further, in the present invention, the back light is allowed to emit light during only a period of time from the time at which writing scan of pixel data into the liquid crystal panel is completed to the time before erase scanning is started, whereby it becomes possible to contribute all the amount of light emission in the back light to execution of display.

The above and further objects and features of the invention will more fully be apparent from the following detailed description with accompanying drawings.

BRIEF DESCRIPTION OF THE SEVERAL VIEWS OF THE DRAWINGS

FIG. 8 is a time chart showing a relationship between an amount of light emission in the back light and a display condition in the liquid crystal panel in the first embodiment of a display control method of the liquid crystal display unit according to the present invention;

FIG. 10 is a time chart for explaining the principle of the second embodiment in a display control method of the liquid crystal display unit according to the present invention;

DESCRIPTION OF THE PREFERRED EMBODIMENTS

The present invention will be described in detail hereinafter in conjunction with the accompanying drawings illustrating the embodiments therefor.

Figure 1:
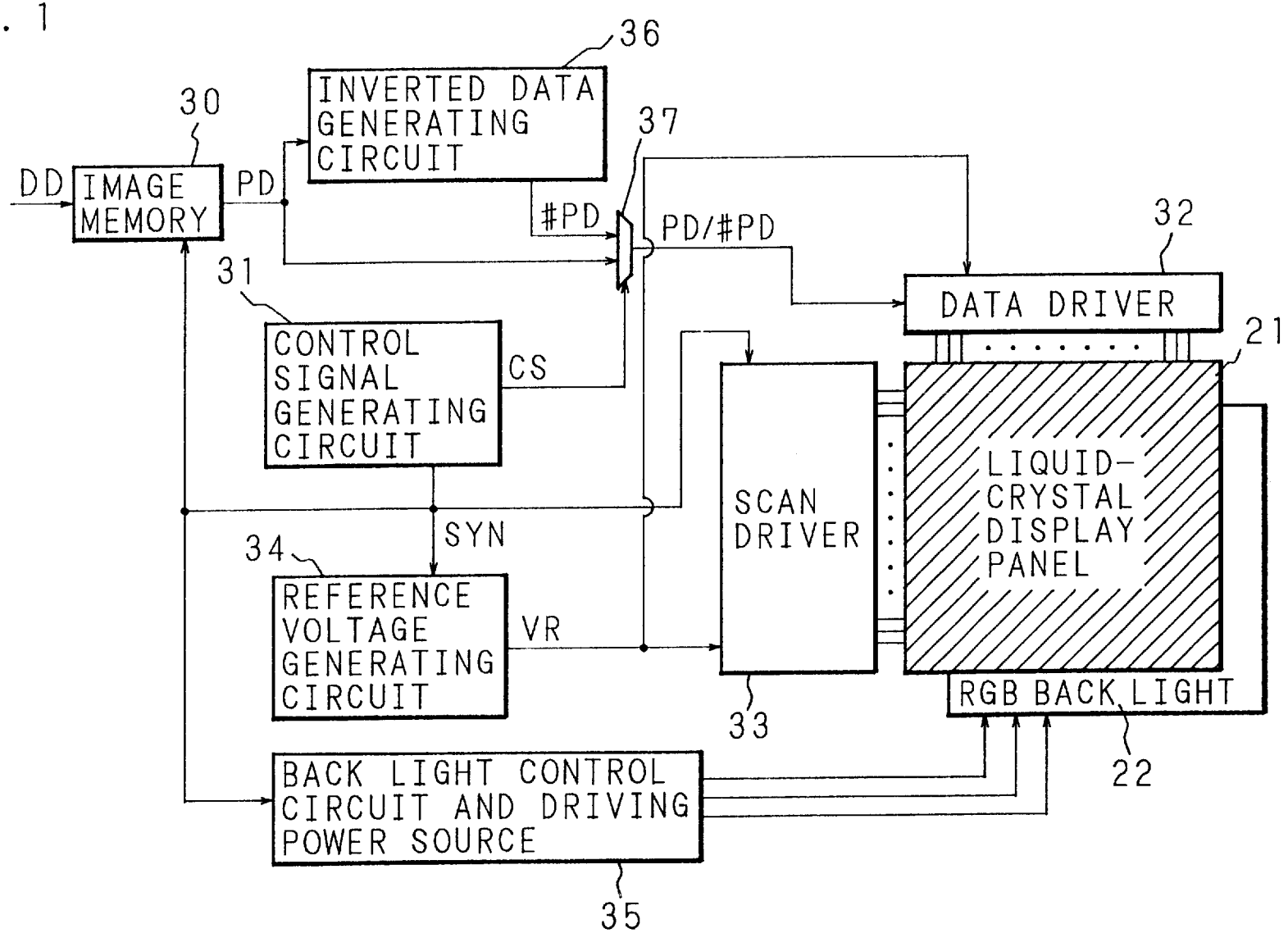
FIG. 1 is a block diagram showing an example of the constitution of the liquid crystal display unit according to the present invention.
Figure 2:
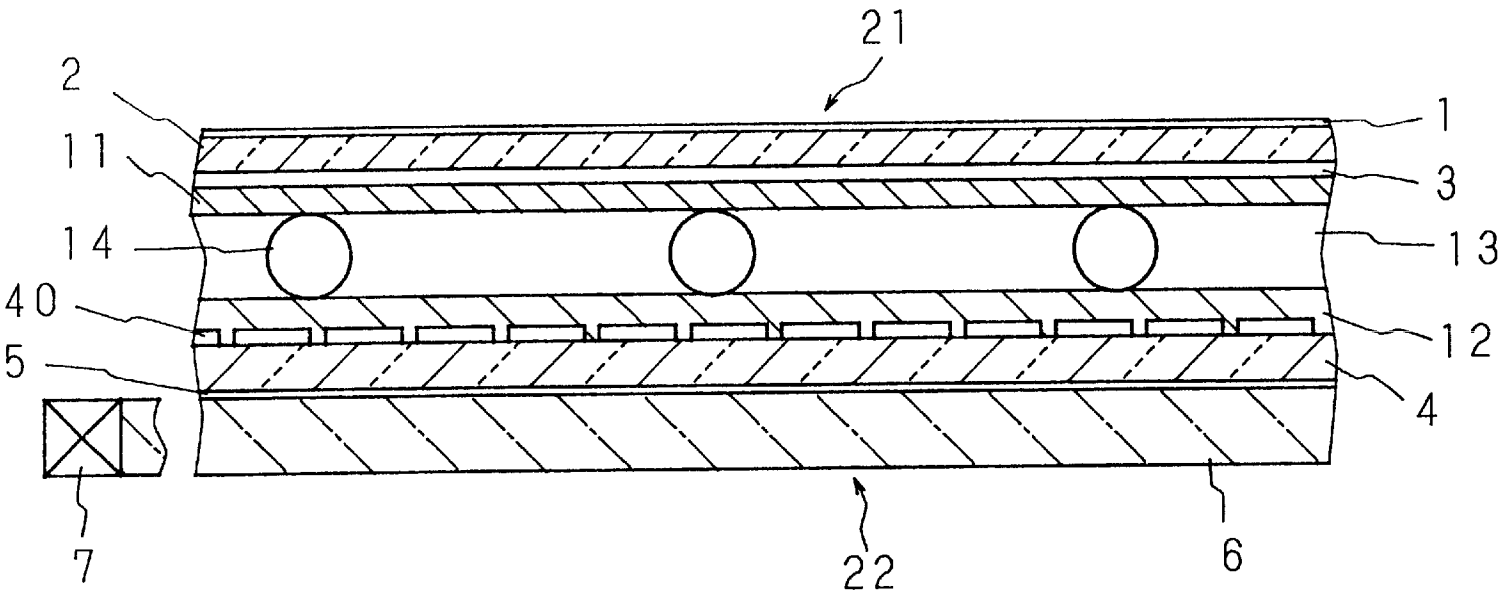
FIG. 2 is a schematic sectional view showing a liquid crystal panel and a back light used in the liquid crystal display unit according to the present invention.
Figure 3:
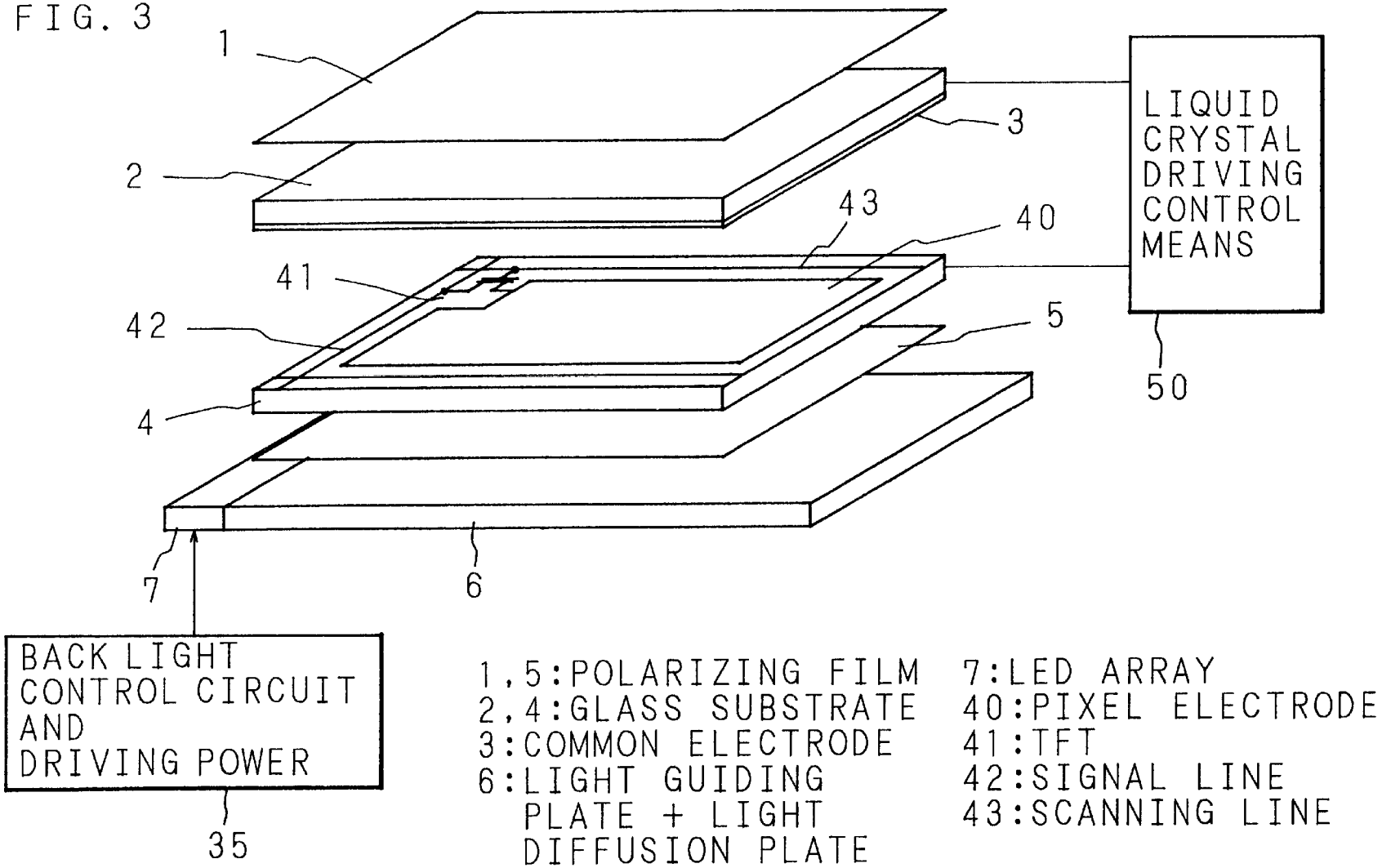
FIG. 3 is a schematic view showing a whole constitutional example of the liquid crystal display unit according to the present invention.
Figure 4:
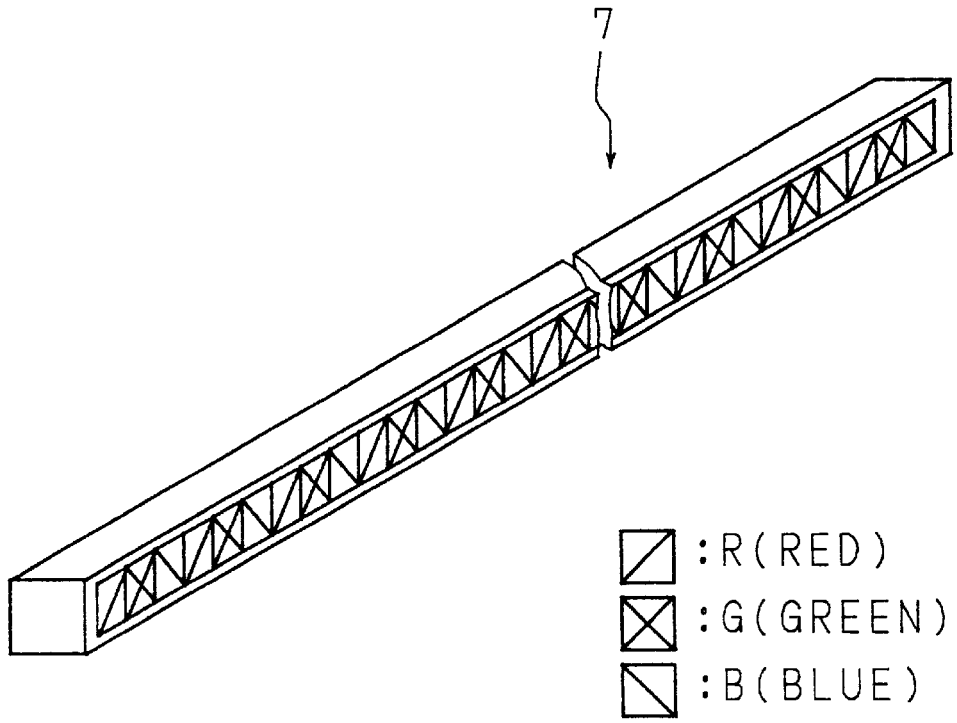
FIG. 4 is a schematic view showing a constitutional example of an LED array.

FIG. 1 is a block diagram showing an example of the constitution of a liquid crystal display according to the present invention, FIG. 2 is a schematic sectional view showing a liquid crystal panel and a back light in the display unit, FIG. 3 is a schematic perspective view showing an example of the constitution of liquid crystal panel and back light, and FIG. 4 is a schematic view showing an example of the constitution of LED array.

In FIG. 1, reference numerals 21 and 22 designate a liquid crystal panel and a back light, respectively, sectional structures of them are shown in FIG. 2 wherein the back light 22 is composed of an LED array 7 and a light guiding plate+a light diffusion plate 6 as shown in FIG. 2.

The liquid crystal panel 21 has a structure that disposed between two polarizing films 1 and 5 as shown in FIG. 2 and FIG. 3. More specifically, the liquid crystal panel 21 is composed by laminating the polarizing film 1, a glass substrate 2, a common electrode 3, a glass substrate 4, the polarizing film 5, and the light guiding plate+the light diffusion plate 6 in this order from the top side to the bottom side wherein pixel electrodes 40 corresponding to individual display pixels arranged in matrix-form are formed on the face of the glass substrate 4, respectively, on the side of the common electrode 3. A liquid crystal driving control means 50 comprising a data driver 32 and a scan driver 33 or the like and which will be mentioned hereinafter is connected across the common electrode 3 and the pixel electrodes 40. Furthermore, individual pixel electrodes 40 are subjected to ON/OFF control by means of TFTs (Thin Film Transistors) wherein a signal line 42 and a scanning line 43 of each TFT is selectively turned ON/OFF by the data driver 32 and the scan driver 33, respectively, whereby the TFT is driven. Thus, intensity of transmitted light in each pixel is controlled by a signal from the signal line 42.

An orientation film 12 is disposed on the upper surfaces of the pixel electrodes 40 on the glass substrate 4, and an orientation film 11 is also disposed on the under surface of the common electrode 3. A spacing defined between these both orientation films is charged with a liquid crystal material to form a liquid crystal layer 13. Reference numeral 14 designates a spacer for maintaining suitably a thickness of the liquid crystal layer 13.

The back light 22 is positioned on the bottom of the liquid crystal panel 21 with which is provided the LED array 7 in a state wherein it is protruded from the light guiding plate+the light diffusion plate 6 composing a light emitting region. As shown in a schematic diagram of FIG. 4, on the side of the LED array 7 which is opposite to the light guiding plate+the light diffusion plate 6 are arrayed successively and repeatedly LEDs emitting light rays of three primary colors of red (R), green (G), and blue (B), respectively. The light guiding plate+the light diffusion plate 6 guide the light emitted from the respective LEDs of the LED array 7 to the whole surface of the light guiding plate+the light diffusion plate 6 themselves, and at the same time diffuse the light towards the upper surface thereof thereby to function as a light emitting region.

In FIG. 1, to an image memory 30 are given display data DD to be displayed on the liquid crystal panel 21 from an outside source such as personal computer. The image memory 30 stored once the display data DD therein, and then outputs data per each pixel unit (hereinafter referred to as "pixel data PD") in synchronous with synchronizing signal SYN generated from a control signal generating circuit 31. The pixel data PD outputted from the image memory 30 is inputted to a selector 37 without any modification, and it is also applied to an inverted data generating circuit 36 at the same time.

The inverted data generating circuit 36 is a circuit for generating inverted data of the pixel data PD outputted from the image memory 30, and the output signals therefrom are given to the selector 37 as inverted pixel data #PD. Thus, to the selector 37 are inputted the pixel data PD outputted from the image memory 30 and the inverted pixel data #PD outputted from the inverted data generating circuit 36, and either data of them is outputted to the data driver 32 in accordance with control signal CS given from the control signal generating circuit 31.

The data driver 32 controls ON/OFF in signal lines 42 of the pixel electrodes 40 in accordance with the pixel data PD or the inverted pixel data #PD outputted from the selector 37.

From the control signal generating circuit 31 are outputted synchronizing signal SYN, and it is applied to the scan driver 33, a reference voltage generating circuit 34, and a back light control circuit and driving power source 35, respectively.

The scan driver 33 controls ON/OFF in scanning lines 43 of the pixel electrodes 40 in synchronous with synchronizing signal SYN given from the control signal generating circuit 31. The reference voltage generating circuit 34 generates reference voltage VR in synchronous with a synchronizing signal SYN, and the reference voltage YR is applied to the data driver 32 and the scan driver 33.

The back light control circuit and driving power source 35 apply driving voltage to the back light 22 in synchronous with synchronizing signal SYN given from the control signal generating circuit 31 to make the LED array 7 in the back light 22 luminous.

Figure 5:
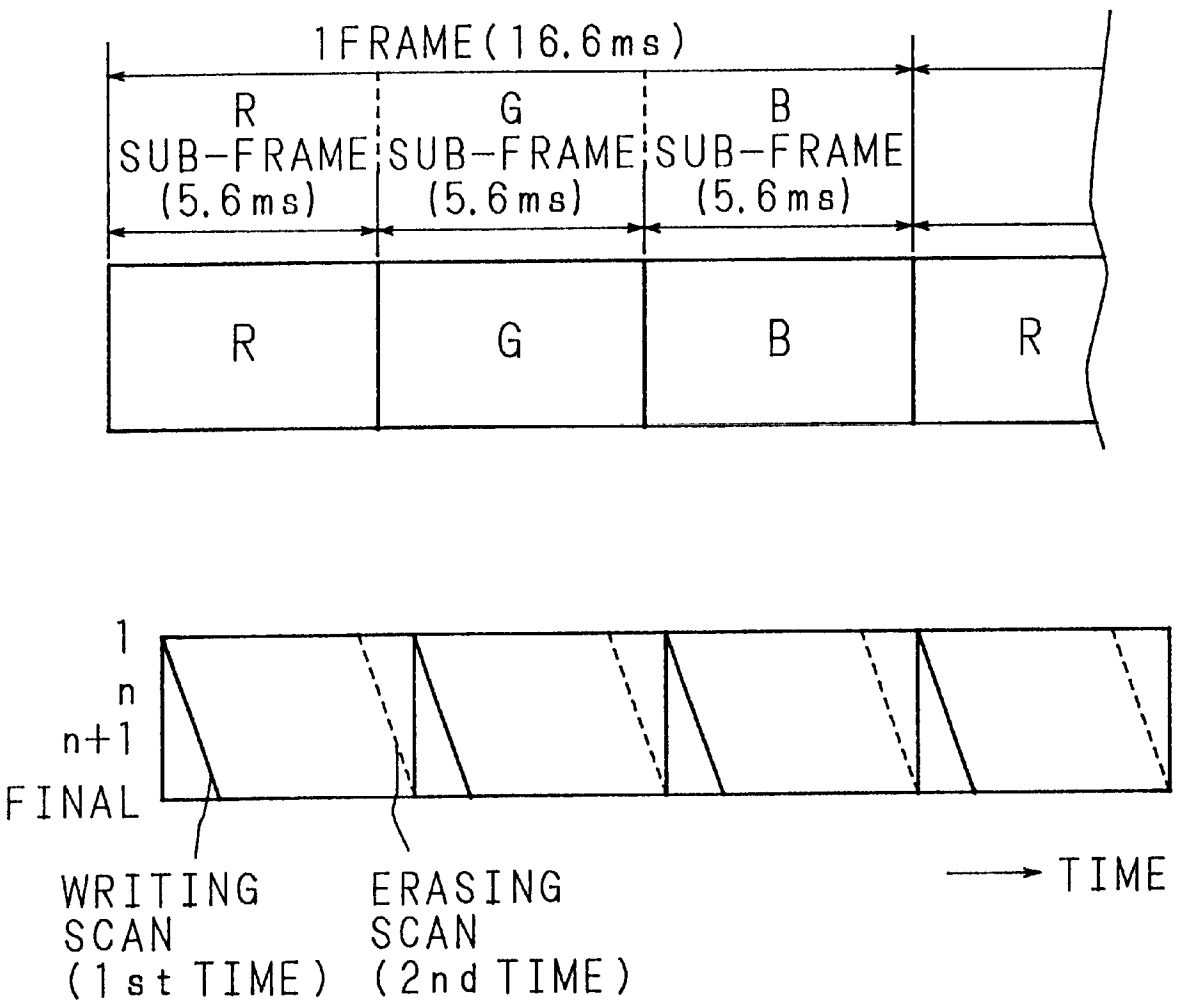
FIG. 5 is a time chart for explaining the principle of the first embodiment in a display control method of the liquid crystal display unit according to the present invention.

Display operation of the liquid crystal display unit as described above according to the present invention will be described hereinafter. FIG. 5 is a time chart showing a relationship between light emission timing in LEDs of respective colors of the back light 22 and scanning timing of respective lines in the liquid crystal panel 21 and for explaining the principle of a first embodiment in a display control method of the liquid crystal display unit according to the present invention.

As shown in FIG. 5(*a*), the LEDs of the back light 22 are allowed to be luminous successively in the order of red, green, and blue in, for example, every 5.6 ms, and respective pixels in the liquid crystal panel 21 are switched in synchronous with the light emission with a line unit to display an image. When display in 60 frames for 1 second is carried out, a period for one frame becomes 16.6 ms. The period for the one frame is further divided into 3 sub-frames in every 5.6 ms, and the LEDs of the respective colors of red, green, and blue in the back light 22 are subjected to light emission in the respective frames. For instance, in the example shown in FIG. 5(*a*), a red LED, a green LED, and a blue LED are allowed to be luminous in the first sub-frame, the second sub-frame, and the third sub-frame, respectively, in accordance with control of the back light control circuit and the driving power source 35.

In the case where each sub-frame and one frame are set to 5.6 ms and 16.6 ms, respectively, as mentioned above, it becomes possible to display about 60 frames in 1 second, so that luminance flicker in display is not observed in general by human eyes. However, this is a mere example, and accordingly, display may be carried out in 30 frames for 1 second as in, for example, television broadcasting as a matter of course.

On one hand, writing scan into sub-frames of respective colors of red, green, and blue is carried out twice with respect to the liquid crystal panel 21 by means of the data driver 32 and the scan driver 33. However, the timing is adjusted in such that starting timing for the first writing scan (writing timing into the first line) is coincident with starting timing of each sub-frame, and further finishing timing for the second writing scan (writing timing into the final line) coincides with finishing timing of each sub-frame.

Moreover, in the first writing scan, the control signal generating circuit 31 makes the selector 37 to output pixel data PD by means of control signal CS, and signals of voltage corresponding to the pixel data PD outputted from the selector 37 are supplied from the data driver 32 to respective pixels in the liquid crystal panel 21, whereby electric field is applied to adjust transmittance, so that an image corresponding to the pixel data PD is displayed. Hence, full-colored display is performed.

In the second writing scan, the control signal generating circuit 31 makes the selector 37 to output inverted pixel data #PD by means of control signal CS, and signals of voltage corresponding to the inverted pixel data #PD outputted from the selector 37 are supplied from the data driver 32 to respective pixels in the liquid crystal panel 21, whereby electric field of reverse polarity having the same intensity as that which was applied to the respective pixels in case of the first writing scan is applied. As a result, display in the respective pixels of the liquid crystal panel 21 is erased.

In a conventional liquid crystal display unit, after pixel data PD have been once written, control for erasing such data is not carried out, but such control for substituting directly the following pixel data PD for the previous data has been made. In the present invention, however, such control that pixel data PD are erased with inverted pixel data #PD in a predetermined cycle after having been written the pixel data PD as mentioned above is performed, so that a displaying period of time for a screen of the liquid crystal panel 21 in all the pixels, in other words, a period of time wherein liquid crystal is in a display state in each pixel becomes equal to each other, and thus, no fluctuation in luminance occurs.

Furthermore, since voltage of signals supplied to each pixel of the liquid crystal panel 21 in cases of either the first or the second writing scan is the one having the same magnitude and only different polarity, application of DC component to the liquid crystal is prevented.

Meanwhile, since ferroelectric liquid crystal has polarity responsibility, it is decided whether incident light is allowed to pass through or it is prevented dependent upon the polarity of applied voltage, and further such ferroelectric liquid crystal has also memorization for maintaining such a situation as described above. For this reason, in case where either a relationship between polarization axes of the polarizing films 1 and 5 and a direction of molecular major axis of liquid crystal, or polarity of applied voltage is not optimum when voltages were applied to respective pixels as a result of the second scanning with respect to twice operations for one sub-frame being a characteristic feature of the present invention as mentioned above, the liquid crystal panel 21 comes to be a state where back light beam is not completely prevented, so that either there arises mixed of color, or a case where no desired color can be displayed, resulting in decrease in image quality.

Figure 6:
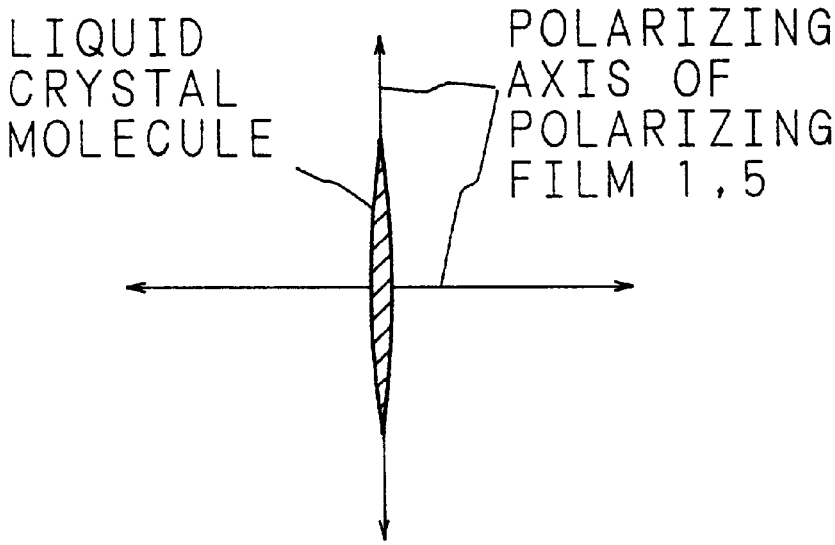
FIG. 6 is a schematic diagram showing a relationship between a direction along molecular major axes (optical axis) of liquid crystal molecules and directions of polarization axes of two polarizing films in the liquid crystal display unit according to the present invention.

In these circumstances, according to the present invention, either the liquid crystal panel 21 is constituted in such that a direction along each molecular major axis (optical axis) of substantially all the ferroelectric liquid crystal molecules is coincident with either polarization axis of two polarizing films 1 and 5 which are disposed so as to put a panel therebetween and when polarization axes cross at right angles with each other as shown in a schematic diagram of FIG. 6, or the same situation is intended to maintain by making polarity of voltage applied to each pixel be optimum, when voltage is applied to each pixel of the liquid crystal panel 21 by the second writing scan, whereby displayed image is positively erased.

Specific examples of the liquid crystal display unit and the display control method therefor will be described hereunder.

First, the liquid crystal panel 21 shown in FIG. 2 and FIG. 3 was made as follows. A TFT substrate of matrix-shape having 12.1 inch diagonal line wherein an individual pixel electrode has 0.24 mm×0.24 mm pitch, and the number of pixel is 1024×768 was made. The resulting TFT substrate and a glass substrate 2 provided with a common electrode 3 were washed, then, polyimide was applied thereto by means of a spin coater, and baked at 200° C. for one hour, whereby polyimide films of each about 200 angstrom were formed as orientation films 11 and 12. Furthermore, these orientation films 11 and 12 were rubbed with a cloth made of rayon, and these films were superposed one another while keeping a gap therebetween by the use of spacers 14 each having an average particle diameter of 1.6 $\mu$m to obtain a vacant panel. A ferroelectric liquid crystal containing naphthalene-base liquid crystal as the major component was sealed in the gap defined between the orientation films 11 and 12 to prepare a liquid crystal layer 13.

The panel thus made was sandwiched between two polarizing films (NPF-EG1225DU manufactured by Nittoh Denkoh Co.) 1 and 5 in a crossed Nicols state in such a manner that when ferroelectric liquid crystal molecules in the liquid crystal layer 13 incline to one side, it results in a dark state, thereby preparing a liquid crystal panel 21. Then, the liquid crystal panel 21 was placed on a back light 22, more specifically a light guiding plate+a light diffusion plate 6.

Figure 7:
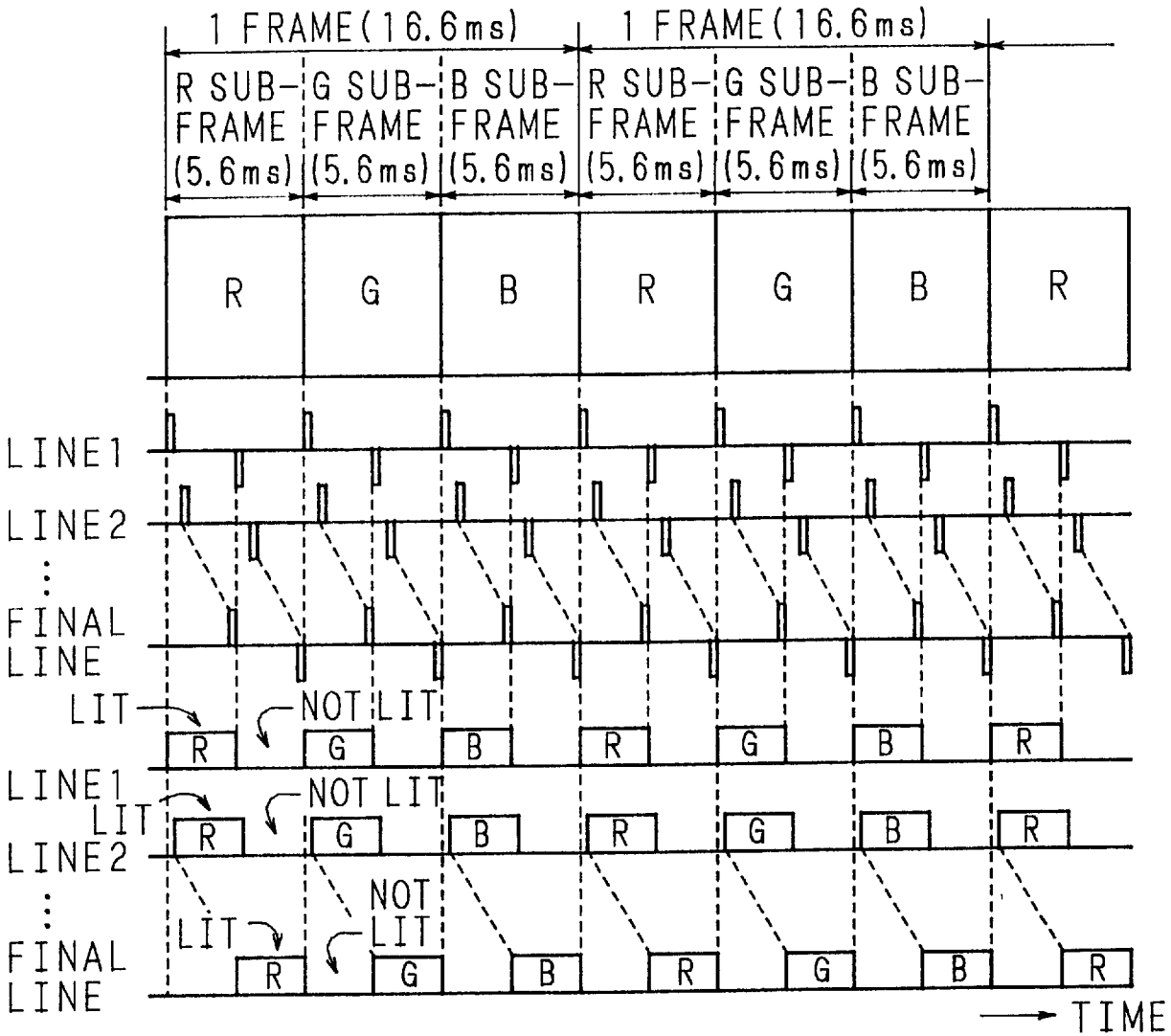
FIG. 7 is a time chart for explaining the first embodiment in a display control method of the liquid crystal display unit according to the present invention.

In the structure wherein the liquid crystal panel 21 made as mentioned above was placed on the back light 22 composed of an LED array 7 and the light guiding plate+the light diffusion plate 6, the display control as shown in FIG. 7 was carried out.

In sub-frame periods of time for respective colors of red, green, and blue which are obtained by dividing equally 1 frame period of time of 16.6 ms into three sections as shown in FIG. 7(*a*), writing scan with respect to the ferroelectric liquid crystal panel 21 was carried out twice by line unit as shown in FIG. 7(*b*).

The first writing scan is carried out in such that a signal of voltage corresponding to each pixel data PD is applied with respect to respective pixels in the liquid crystal panel 21 by line unit from the data driver 32 while adjusting timing in such a manner that a starting timing of writing scan into the first line (line 1) of the liquid crystal panel 21 coincides with each other in the starting timing in respective sub-frames. The first application of the voltage to the respective pixels is carried out in every predetermined sifted periods of time from the first line to the final line in due order.

As a result, the respective pixels in the liquid crystal panel 21 are lit by line unit as shown in FIG. 7(*c*). The lighting of the respective pixels is performed in every predetermined shifted periods of time from the first line to the final line in due order.

The second writing scan is carried out in such that a signal having the same voltage as that of the signal and a different polarity of the signal applied in the first writing scan is applied with respect to respective pixels in the liquid crystal panel 21 by line unit from the data driver 32 while adjusting timing in such a manner that a finishing timing of writing scan into the final line of the liquid crystal panel 21 coincides with each other in the finishing timing in respective sub-frames. Although the second application of voltage to the respective pixels is carried out in every predetermined shifted periods of time from the first line to the final line in due order as in the case of first writing scan, timing is adjusted as mentioned above in such that the finishing timing of writing scan into the final line of the liquid crystal panel 21 coincides with each other in the finishing timing of the respective sub-frames, more specifically, starting timing of the second application of voltage to the first line is adjusted.

As a result, the respective pixels of the liquid crystal panel 21 become non-lighting state as shown in FIG. 7(*c*). Transfer of the respective pixels into the non-lighting state is carried out in every predetermined shifted periods of time from the first line to the final line in due order.

Furthermore, as shown in the above-mentioned FIG. 6, structure of the liquid crystal panel 21 was made optimum in such that the direction of molecular major axes (optical axis) of substantially all the ferroelectric liquid crystal molecules was coincident with either of axes of polarization in two polarizing films 1 and 5 whose polarizing axes cross at right angles with each other in the case when voltage was applied to the respective pixels of the liquid crystal panel 21 in the second writing scan. More specifically, the polarizing direction of two polarizing films 1 and 5 whose polarizing axes cross at right angles was made optimum.

When the display control as mentioned above is performed with respect to the liquid crystal panel 21 having the constitution as described above by means of the system having the constitution as shown in FIG. 1, such a high-quality image displaying condition that there are no fluctuation in luminance, and no mixed of colors due to display colors other than that desired was realized. In this case, luminance in white display was 192 cd/m$^2$, and contrast ratio was 35:1.

While in the above-mentioned embodiment, the polarizing direction of two polarizing films 1 and 5 whose polarizing axes cross at right angles with each other has been optimized, polarity of applied voltage may be adjusted in such a manner that the direction of the molecular major axes (optical axis) of substantially all the ferroelectric liquid crystal molecules is coincident with either of axes of polarization of two polarizing films 1 and 5 whose polarizing axes cross at right angles with each other, when voltage was applied to the respective pixels of the liquid crystal panel 21 in case of the second writing scan.

Although ferroelectric liquid crystal has been used for the liquid crystal panel 21 in the above-mentioned embodiment, the same effect as that described above can be obtained, as a matter of course, in also a liquid crystal display wherein a liquid crystal material other than the ferroelectric liquid crystal such as antiferroelectric liquid crystal is employed.

Meanwhile, in the above-mentioned time-shared color liquid crystal display, only the half of the amount of light emission of the back light 22, more specifically of the LED array 7 is utilized in the worst case, it is wasteful in view of power consumption. This is an important problem for transportable office automation equipment which is usually driven by battery. In this connection, the second embodiment wherein more reduction of power consumption can be realized in the above-mentioned display control method will be described herein.

The time chart of FIG. 8 shows a relationship between an amount of light emission in the back light 22 and a display condition in the liquid crystal panel 21 in the above-mentioned first embodiment. As shown in FIG. 8(*a*), it is arranged in such that in a sub-frame period of time of 5.6 ms, the first application of voltage begins at the same time of starting time of the sub-frame, and continues for 2.8 ms of the following period of time, while the second application of voltage begins at the time 2.8 ms passed from the starting time of the sub-frame and continues for a period of 2.8 ms succeeding thereto, i.e., until the time at which the sub-frame is completed.

In the event as described above, a period of time for lighting pixel is only ½ of one sub-frame during a period of time for 5.6 ms as shown in FIG. 8(*b*) in the case when viewed in each line unit. Accordingly, as shown in FIG. 8(*a*), a light emission period of time being contributed actually by the back light 22 is also ½, and the remaining ½ period of time is shaded and useless. In this case, if it is sufficient for a period of time shorter than the scanning period of time for liquid crystal panel of 2.8 ms indicated in FIG. 8, efficiency for utilization of the back light 22 is increased. However, in TFT made from amorphous silicon in the present state, its mobility is low so that remarkable reduction for scanning period of time is not expected.

In order to solve the problem as described above, a region for light emission of the back light 22 is divided into at least two blocks, and switching for light emission and extinguishing light is carried out in synchronous with writing scanning/erasing scanning of data with respect to the liquid crystal panel 21 in the second embodiment according to the present invention.

Figure 9:
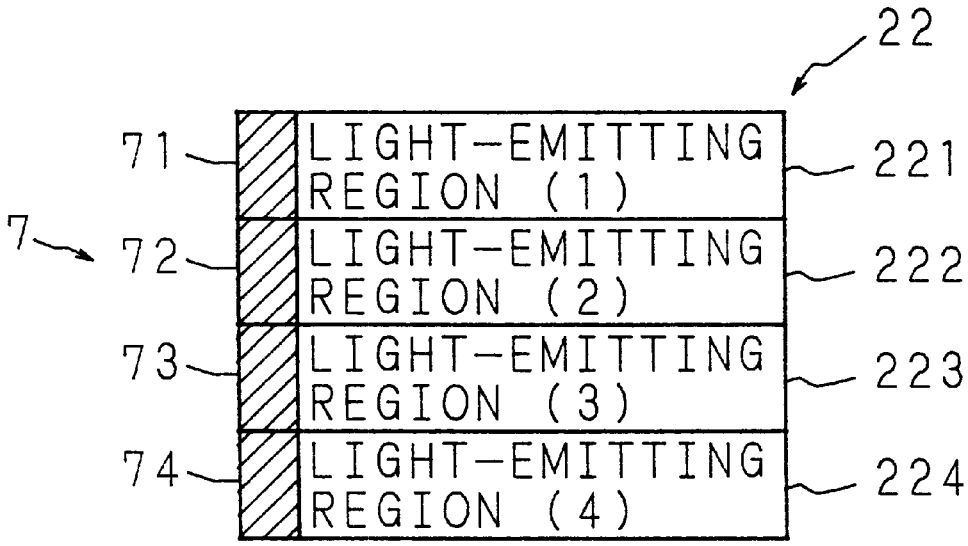
FIG. 9 is a schematic diagram showing a divided state in a light-emitting region of the back light in the liquid crystal display unit according to the present invention.

First, the principle of the second embodiment will be described. FIG. 9 is a schematic diagram showing an example wherein the back light 22 is taken up as an example, and a region for light emission thereof is divided equally into four blocks. In this example, a light guiding plate+a light diffusion plate 6 are divided into equal four strip-shaped light-emitting region (1) 221 to light-emitting region (4) 224 with each shading film disposed in the direction of line in a liquid crystal panel 21, and further an LED array 7 is also divided into four LED array blocks 71 through 74 in response to the former division. Each of the LED array blocks 71 through 74 contains the same number of red, green, and blue LEDs in each at least one LED, and light-emitting region (1) 221, light-emitting region (2) 222, light-emitting region (3) 223, and light-emitting region (4) 224 are subjected to light-emission control by means of LED array block 71, LED array block 72, LED array block 73, and LED array block 74, respectively.

Display control of the second embodiment according to the present invention involving such back light 22 as described above will be described by referring to the time chart in FIG. 10.

As shown in FIG. 10, the back light 22 is emitted and extinguished in synchronous with scanning of the liquid crystal panel 21. More specifically, light emission is made by the LED array block 71 during a period for scanning respective lines of the liquid crystal panel 21 corresponding to the light-emitting region 221 of the back light 22, light emission is made by the LED array block 72 during a period for scanning respective lines of the liquid crystal panel 21 corresponding to the light-emitting region 222, light emission is made by the LED array block 73 during a period for scanning respective lines of the liquid crystal panel 21 corresponding to the light-emitting region 223, and light emission is made by the LED array block 74 during a period for scanning respective lines of the liquid crystal panel 21 corresponding to the light-emitting region 224, respectively.

Thus, when each period of time for sub-frames of red, green and blue is made to be 5.6 ms, and each time of writing scanning/erasing scanning of data with respect to the liquid crystal panel 21 is made to be 2.8 ms, a period of time for light emission in the sub-frames of the respective light-emitting regions 221 to 224 becomes sufficient for 3.5 ms. Accordingly, 62.5% of reduction can be attained with respect to the case of 5.6 ms shown in FIG. 8. In other words, power consumption can be saved by about 37.5%. In this case, a period of time required for such condition that the respective pixels in the liquid crystal panel 21 are in a display state (a data-writing state) is 2.8 ms as in the above-mentioned first embodiment, so that display luminance is not affected thereby. On the contrary, a period of time wherein the back light 22 is not lit becomes prolonged in a situation where light from the back light 21 is not desired to essentially come through the surface of the liquid crystal panel 21, i.e., a period wherein the respective pixels in the liquid crystal panel 21 are in an undisplayed state (ratio in extinguishing light of the back light 22 is 0% in the above-mentioned embodiment). For this reason, improvements are also attained in view of contrast ratio, and purity in display color.

Relationships in ratio of light-emitting period of time in comparison of the numbers of division with the case where a light-emitting region of the back light 22 has been divided versus the case where no division has been carried out are shown in the following Table 1.

TABLE 1

| Number of Division in Light-emitting Region | Light-emitting Period of Time (ms) | Ratio (vs. Case of No Division) |
|---|---|---|
| 1 | 5.6 | 100.0 |
| 2 | 4.20 | 75.0 |
| 4 | 3.50 | 62.5 |
| 6 | 3.26 | 58.3 |
| 8 | 3.15 | 56.3 |
| 10 | 3.08 | 55.0 |
| 20 | 2.94 | 52.5 |
| 50 | 2.856 | 51.0 |
| 100 | 2.828 | 50.5 |

As is apparent from Table 1, with increase in the number of division for light-emitting region if the back light 22, a light-emitting period of time for each light-emitting region during a period for each sub-frame decreases. In this case, when number of division in light-emitting region is represented by $N_B$, a ratio R of light-emitting period of time with respect to the case of no division is expressed by the following equation:

$$R=0.5+1/(2*N_B)$$

A result becomes gradually close to 50% with increase of the number of division in light-emitting region. Accordingly, the larger number of division $N_B$ in light-emitting region results in the higher power consumption up to 50% at the most.

In the above description, although a light-emitting period of time has been equally divided in response to the number of division in the light-emitting region if the back light 22, and timing for emission/extinguishment of light has not been overlapped each other, such timing may be allowed to overlap each other if required, as a matter of course.

Figure 11:
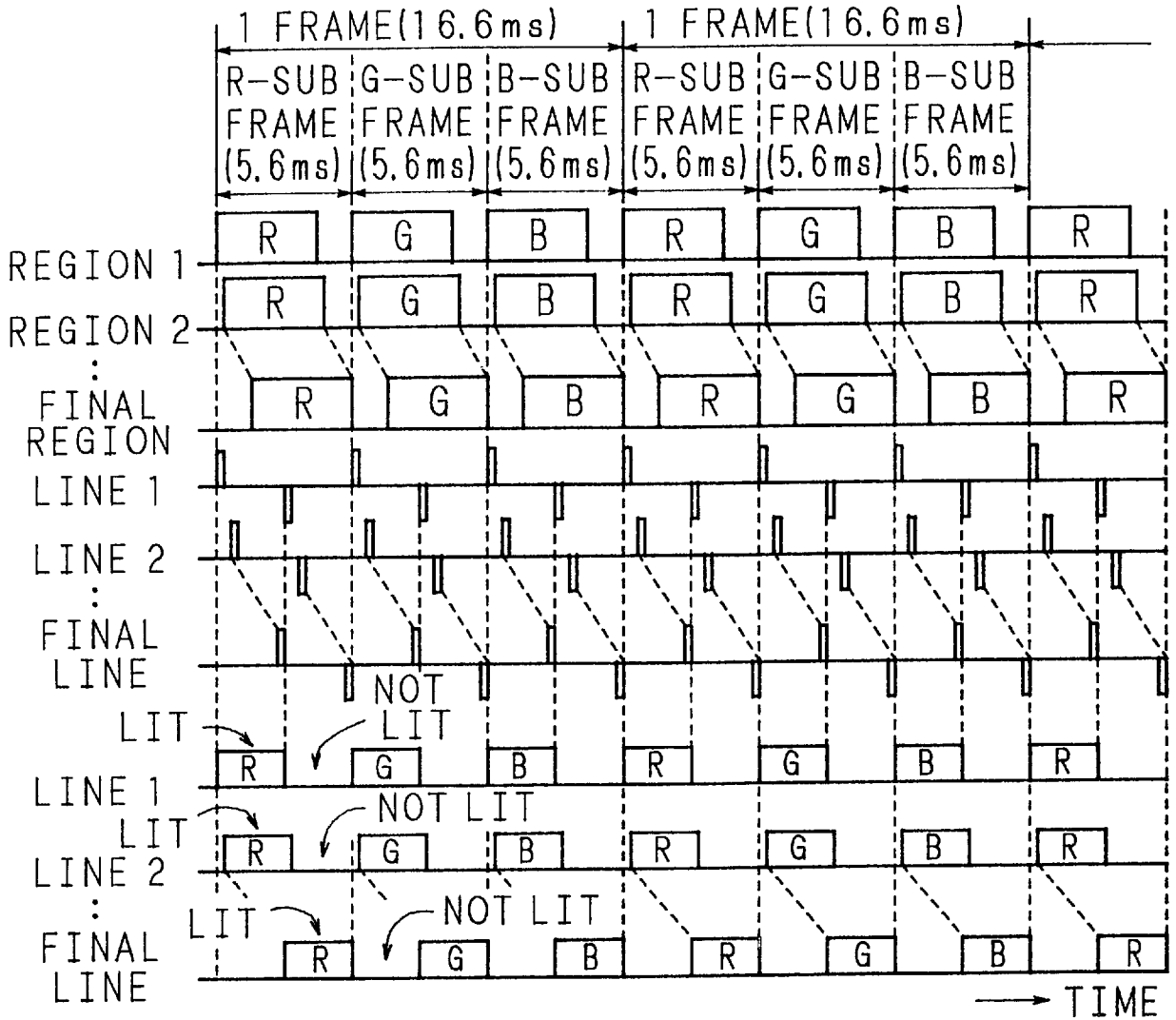
FIG. 11 is a time chart for explaining the second embodiment in a display control method of the liquid crystal display unit according to the present invention.

Specific examples of the second embodiment according to the present invention as mentioned above will be described hereinafter wherein the liquid crystal panel 21 used herein is the same as that which has been used in the above-mentioned embodiment, and the display control as shown in the time chart of FIG. 11 is performed.

As shown in FIG. 11(*a*), first, red light emission is successively carried out in every predetermined shifted periods of time during a period for one sub-frame in respective light-emitting regions 221, 222, . . . of the back light 22. Then, as shown in FIG. 11(*b*), during light emission of the light-emitting region 221 in the back light 22, writing scanning/erasing scanning of pixel data, more specifically writing scanning of pixel data PD/writing scanning of inverted pixel data #PD is carried out with respect to lines of the liquid crystal panel 21 corresponding to the region under state of light emission. Namely, light emission of the respective light-emitting regions 221, 222, . . . in the back light 22 are controlled in synchronous with control of writing scanning/erasing scanning of data with respect to the respective lines of the liquid crystal panel 21. As a result, display is performed by realizing a lighting or a non-lighting state of the liquid crystal panel 21 as shown in FIG. 11(*c*).

Following to the above step, during each period for green sub-frames and each period for blue sub-frames, the same display control is carried out to complete one frame. When such one frame control as described above is repeated, display of 60 frames in 1 second is possible.

In this embodiment, clear full color display being excellent in color purity could be realized. In time-shared color display, when each period for the respective red, green, and blue sub-frames was made to be 5.6 ms, periods of time of writing scanning/erasing scanning of data was made to be 2.8 ms, respectively, and a light-emitting region if the back light 22 was divided into 4 blocks, a light-emitting period of time for the respective light-emitting regions 221, 222, 223, and 224 could be reduced to about 3.5 ms, respectively. In this case, emission luminance of the single back light 22 was 631 cd/m$^2$, while luminance in case of white display in combination with the liquid crystal panel 21 was 190 cd/m$^2$, and contrast ratio was 43:1. Efficiency for utilization of amount of light emission in the back light 22 was about 30%. Furthermore, as a result of examining power consumption of the back light 22, it was 19 W.

As another example, actual display control was carried out under such condition that the same liquid crystal panel 21 as mentioned above was employed, the back light 22 was divided equally into ten blocks to prepare light-emitting regions 221, 222, . . . , further, each period of time for respective red, green, and blue sub-frames was made to be 5.6 ms, and periods of time of writing scanning/erasing scanning of data with respect to the liquid crystal panel 21 were made to be 2.8 ms, respectively.

In this case, since the light-emitting region of the back light 22 was divided into ten light-emitting regions 221, 222, . . . , a lighting period of time for each of the light-emitting regions 221, 222 . . . could be reduced to about 3.1 ms. In this example, emission luminance of single back light 22 was 560 cd/m$^2$, luminance in case of white display in combination with the liquid crystal panel 21 was 194 cd/M$^2$, and contrast ratio was 51:1. Efficiency for utilization of amount of light emission in the back light 22 was increased to about 35%. Further, as a result of examining power consumption of the back light 22, it was 16 W which is a lower value than that of the above-mentioned example.

As described above, since the number of division for light-emitting regions in the back light 22 was increased in the present embodiment, its contrast ratio was improved, besides power consumption decreased while achieving the equal white level to that of the above-mentioned example.

As a comparative example with respect to the above-mentioned two embodiments, display control was performed by employing the same liquid crystal panel 21 as that used in these two embodiments with no division of the back light 22.

In this example, as a result of color displaying in time-sharing manner in such that light emission of the back light 22 is controlled in synchronous with writing scanning/erasing scanning of data with respect to the liquid crystal panel 21, clear color display being excellent in color purity could be obtained. However, when each period of time for respective red, green, and blue sub-frames (light-emitting period of time) was made to be 5.6 ms, and periods of time of writing scanning/erasing scanning of data with respect to the liquid crystal panel 21 were made to be 2.8 ms, respectively, emission luminance of single back light 22 was 1009 cd/m$^2$, luminance in case of white display in combination with the liquid crystal panel 21 was 192 cd/m$^2$, and contrast ratio was 35:1. Efficiency for utilization of amount of light emission in the back light 22 was as low as about 19%, and power consumption for the back light 22 was 31 W which was a higher value than that in both the embodiments wherein the above-mentioned light-emitting region if the back light 22 was divided.

As described above, when light emission was performed without dividing the light-emitting region of the back light 22, contrast ratio is low, and power consumption becomes high, although white level is equal to that of the above-mentioned two examples.

In the above-mentioned respective embodiments and the comparative example, while ferroelectric liquid crystal has been used for the liquid crystal panel 21, the same effect is obtained also in a liquid crystal display wherein a liquid crystal other than ferroelectric liquid crystal such as anti-ferroelectric liquid crystal is employed, as a matter of course.

As mentioned above, in the case where a light-emitting region of the back light 22 is divided equally into blocks, they are successively emitted, and writing scanning/erasing scanning of data with respect to corresponding respective lines of the liquid crystal panel 21 is carried out in synchronous with the light emission, efficiency for utilization of amount of light emission in the back light 22 approaches gradually to 100% as described above, but does not reach 100%, when the number of division for a light-emitting region if the back light 22 increases. In this respect, when such control that a light-emitting period of time for the back light 22 is utilized at 100% efficiency, in other words, when the back light 22 is allowed to emit light for a period of time wherein the light emission contributes only to display is carried out, it is very advantageous for transportable office automation equipment driven by battery.

Figure 12:
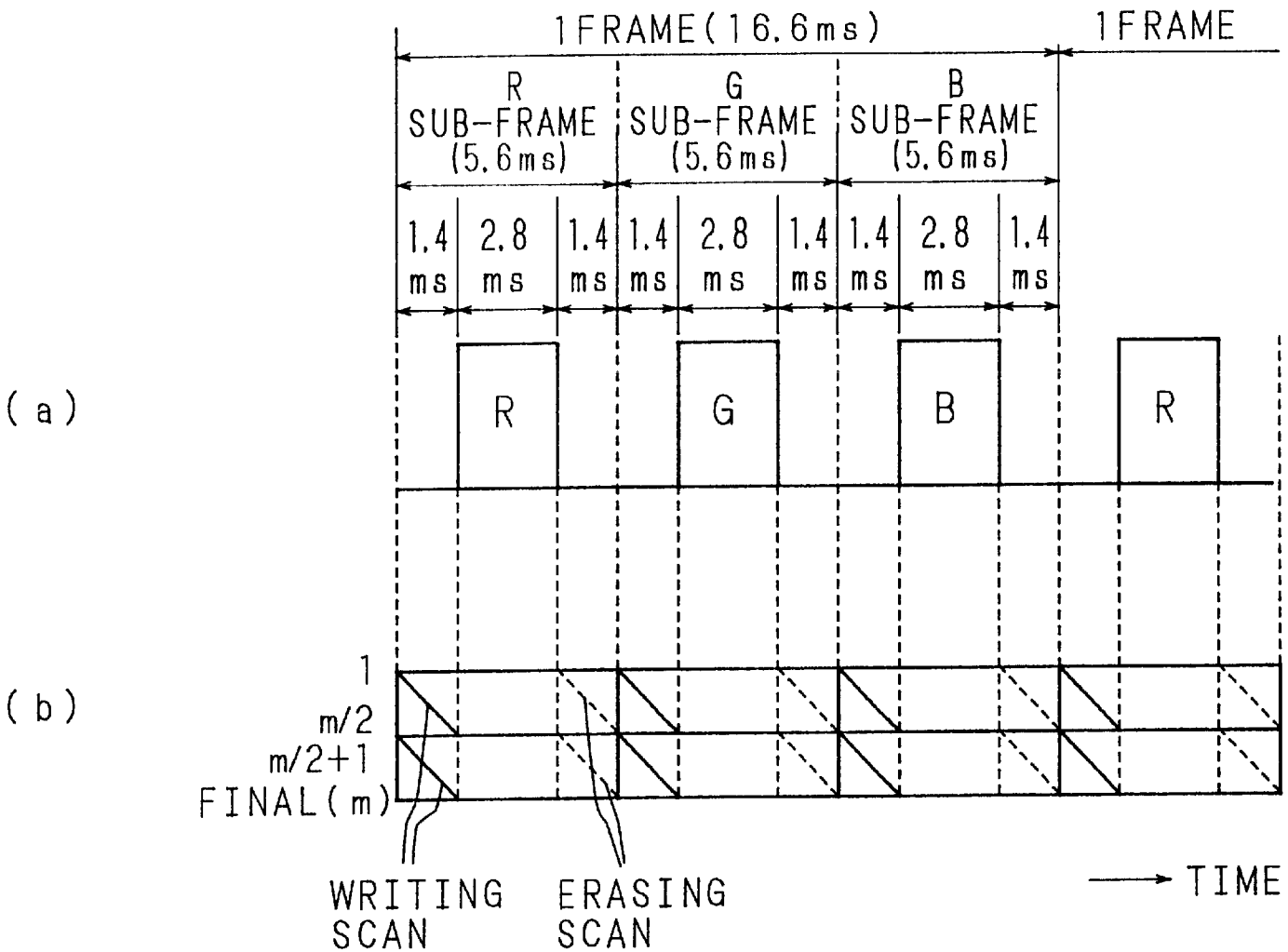
FIG. 12 is a time chart for explaining the principle of the third embodiment in a display control method of the liquid crystal display unit according to the present invention.

FIG. 12 is time chart for such display control as mentioned above in the third embodiment according to the present invention. It is to be noted that in the third embodiment, a light-emitting region of the back light 22 is one as same as the first embodiment.

In the present embodiment, as shown in FIG. 12(*b*), scanning for writing data at line unit as well as scanning for erasing data by applying a voltage which is the same as that applied in case of the former scanning and has reverse polarity are carried out with respect to respective pixels of the liquid crystal panel 21 in respective red, green, and blue sub-frames during one frame period as in the above-mentioned respective embodiments. In this case, as shown in FIG. 12(*a*), light emission is started at the time when writing data into the final line of the liquid crystal panel 21 is completed in the respective sub-frames, while the light emission is stopped at the time before starting erasing of data on the first line of the liquid crystal panel 21 in the respective sub-frames. In other words, the back light 22 is controlled so as to emit light during only the period wherein all the pixels in the liquid crystal panel 21 are in a display condition in the respective sub-frames. As a result, 100% of light-emitting period for the back light 22 contributes to light emission display by means of the liquid crystal panel 21.

A specific example of the third embodiment as described above will be described hereinafter. Since the liquid crystal panel 21 used herein is substantially the same as that used in the above-mentioned respective examples (except that scanning of TFT is made to be capable of dividing into two blocks, i.e., the upper and the lower sections), the explanation therefor is omitted, and the display control as shown in the time chart of FIG. 13 was applied thereto.

Figure 13:
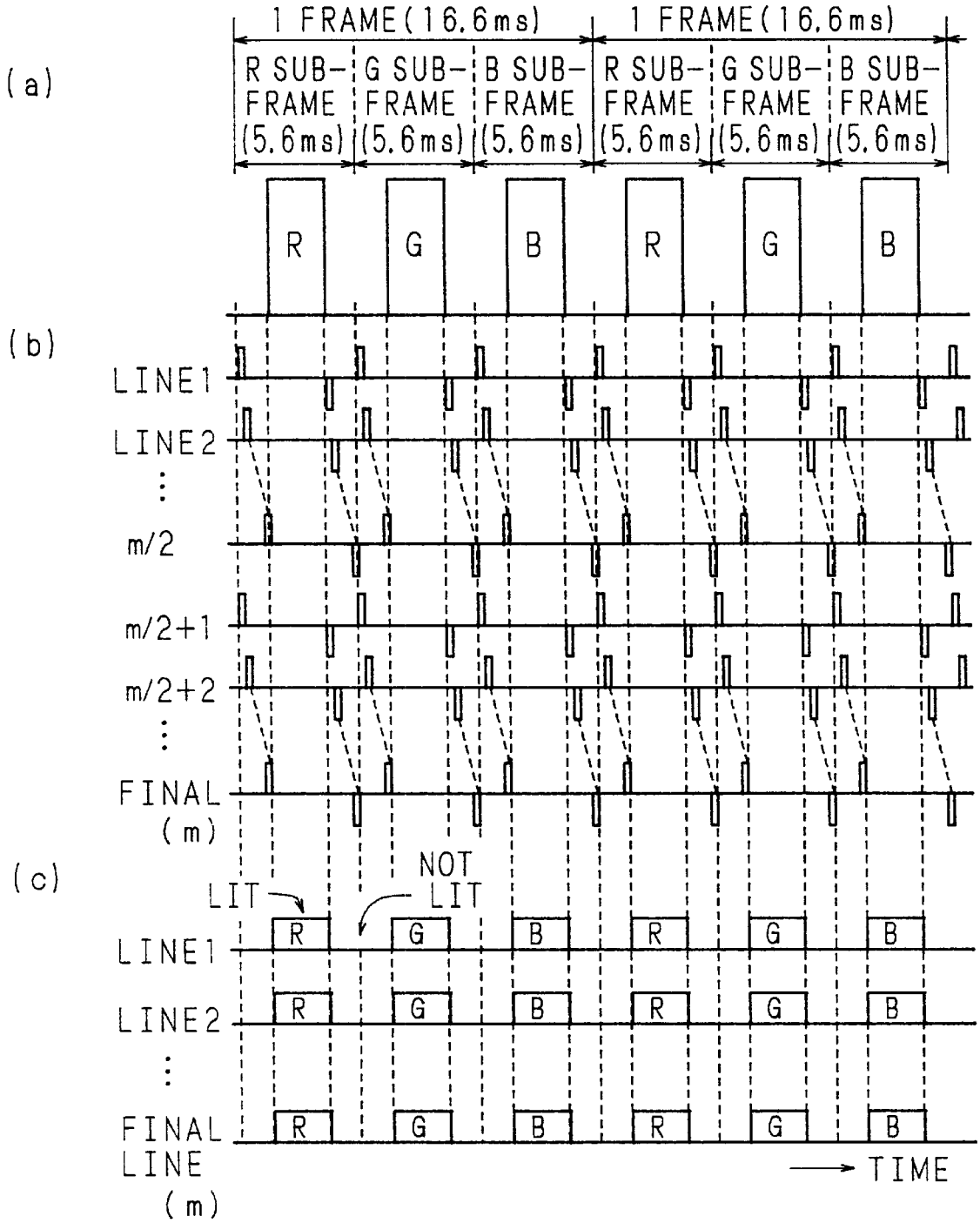
FIG. 13 is a time chart for explaining the third embodiment in a display control method of the liquid crystal display unit according to the present invention.

As shown in FIG. 13(*b*), first, in a red sub-frame, writing scanning of pixel data PD/writing scanning of inverted pixel data #PD are carried out with respect to respective lines in the liquid crystal panel 21. As shown in FIG. 13(*a*), the back light 22 is allowed to emit light during a period of time from the time at which writing of the pixel data PD with respect to all the lines of the liquid crystal panel 21 was completed to the time at which writing of the inverted pixel data #PD is started. As a result, as shown in FIG. 13(*c*), display is carried out by realizing lighting and non-lighting of the respective pixels in the liquid crystal panel 21.

Following to the above step, the same display control is carried out also in each period of time for green and blue sub-frames to complete one frame. When such control for one frame is repeated, display of 60 frames for 1 second is possible.

In such example as described above, clear full-colored display being excellent in color purity could be realized. In the time-shared color display, each period of time for the respective red, green, and blue sub-frames was 5.6 ms, and periods of time of writing scanning/erasing scanning of data of the liquid crystal display 21 was made to be 1.4 ms, respectively. In this case, emission luminance of single back light 22 was 510 cd/m$^2$, luminance in case of white display in combination of the liquid crystal panel 21 was 201 cd/m$^2$, and its contrast ratio was 83:1. As a matter of course, efficiency for utilization of period for light emission in the back light 22 is 100%. It is sufficiently high value with taking such fact that efficiency for utilization of amount of light emission in the back light is about 40% as well as loss due to polarizing films into consideration. As a result of examining power consumption of the back light 22, it was 14 W.

As described above, in the third embodiment, although the driving therefor becomes somewhat complicated as compared with the above-mentioned respective embodiments, 100% of efficiency for utilization of period for light emission of the back light 22 is utilizable. In other words, since the whole amount of light emission in the back light 22 contributes to light-emitting display by means of the liquid crystal panel 21, it is very advantageous for the case of battery driving.

As fully mentioned above, according to the time-shared color liquid crystal display unit of the present invention wherein ferroelectric liquid crystal is used, a display unit which can achieve display of high quality without accompanying luminance fluctuation, mixed of colors due to display colors other than that desired, and the like problems in the whole area of display region is obtained.

Furthermore, according to the present invention, efficiency of utilization for back light can be improved without decreasing display quality, so that a display unit being clear and excellent in display quality and consumes low power is obtained.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A display control method for a liquid crystal display unit which includes two polarizing plates, each polarizing plate having a polarizing axis, the polarizing plates being disposed in directions along which the respective polarizing axes cross at right angles with each other; a liquid crystal panel sandwiched between the polarizing plates, the liquid crystal panel having a plurality of pixels; a back light disposed at the back of the liquid crystal panel, the back light being composed of a light source, and a light-emitting region, the light-emitting region guiding red, green, and blue light emitted from the light source into the liquid crystal panel; a plurality of switching elements, at least one switching element being provided for each one of the plurality pixels, selective ones of the switching elements being ON/OFF driven in response to red, green, and blue data of selected ones of the plurality of pixels during a period of respective display cycles, and at the same time, red, green, and blue light of the back light being emitted in a time-sharing manner in synchronism with the ON/OFF driving of corresponding ones of the plurality of switching elements during the period of respective display cycles, said method comprising:

a first scanning for displaying individual ones of the plurality of pixels of the liquid crystal panel; and a second scanning for erasing the display of said individual ones of the plurality of pixels are carried out in this order, during each period in which the back light emits red, green, blue light in a time-sharing manner;

wherein an electric field is applied to respective ones of said pixels of said liquid crystal panel at each of said first scanning and said second scanning, a direction of said electric field applied to each of said pixels during said first scanning being opposite a direction of said electric field applied to each of said pixels respectively during said second scanning, and a magnitude of said electric field applied to each of said pixels during said first scanning is equivalent to a magnitude of said electric field applied to each of said pixels respectively during said second scanning.

2. The display control method for a liquid crystal display unit as set forth in claim 1, wherein a finishing timing of said first scanning for a given color light is matched to a starting timing of light emission of said given color light, and a starting timing of said second scanning is matched to a finishing timing of light emission of said given color light for each of said red, green and blue colored lights.

3. The display control method for a liquid crystal display unit as set forth in claim 1, wherein a direction of molecular major axes of liquid crystal molecules is made to be substantially coincident with either of polarizing axes of said two polarizing plates in the case when an electric field is applied to respective ones of said pixels of said liquid crystal panel in said second scanning.

4. The display control method for a liquid crystal display unit as set forth in claim 1, wherein a polarity of an applied electric field is controlled such that a direction of molecular major axes of liquid crystal molecules is substantially coincident with either of said polarizing axes of said two polarizing plates when the electric field is applied to respective ones of said pixels of said liquid crystal panel in said second scanning.

5. The display control method for a liquid crystal display unit as set forth in claim 1, wherein said light-emitting region of said back light is divided into at least two, and said light source is divisionally driven in response to said divided light-emitting regions of said back light.

6. The display control method for a liquid crystal display unit as set forth in claim 5, wherein said light source in response to the respective divided light-emitting regions of said back light is controlled in such that said divided light-emitting regions of said back light assume a light-emitting condition or nonemitting condition in synchronism with a scanning of respective ones of said pixels in a section corresponding to said liquid crystal panel.

7. The display control method for a liquid crystal display unit as set forth in claim 5, wherein said light source, in response to said divided light-emitting regions of said back light, is controlled such that the respective divided light-emitting regions of said back light assume a light-emitting condition during only a period wherein selected ones of said pixels of the corresponding section of said liquid crystal panel are in a display state.

8. A liquid crystal display unit, comprising:

two polarizing plates, each said polarizing plate having a polarizing axis, said polarizing plates being disposed in directions along which the respective polarizing axes cross at right angles with each other;

a liquid crystal panel sandwiched between said polarizing plates and composed of a plurality of liquid crystal pixels, and a plurality of switching elements provided in correspondence to said plurality pixels;

a back light composed of a light source, and a light-emitting region which is disposed at the back of said liquid crystal panel, said light-emitting region guides red, green, and blue light emitted from said light source into said liquid crystal panel;

back light control means for controlling said back light so as to output successively red, green, and blue light one by one during a period for one frame wherein an image is displayed; and liquid crystal driving control means for carrying out a first scanning for displaying on individual pixels of said liquid crystal panel, and a second scanning for erasing such display in this order, during each period in which said back light emits red, green, and blue light in a time-sharing manner;

wherein said liquid crystal driving control means controls said first and second scanning such that an electric field is applied to respective pixels of said liquid crystal panel at each of said first scanning and said second scanning, a direction of said electric field applied to each of said pixels during said first scanning being opposite a direction of said electric field applied to each of said particular pixels respectively during said second scanning, and a magnitude of said electric field applied to each of said pixels during said first scanning is equivalent to a magnitude of said electric field applied to each of said pixels respectively during said second scanning.

9. The liquid crystal display unit as set forth in claim 8, wherein:

said liquid crystal driving control means, includes:

storing means for storing pixel data corresponding to respective ones of said pixels of an image to be displayed on said liquid crystal panel;

inverted data generating means for generating inverted data of said respective ones of said pixel data stored in said storing means;

liquid crystal driving means for carrying out said first scanning and said second scanning with respect to individual pixels of said liquid crystal panel during each period in which said back light emits red, green, and blue light in time-sharing manner in this order; and control means for supplying said pixel data stored in said storing means to said liquid crystal driving control means at said first scanning, and supplying the inverted data generated by said inverted data generating means to said liquid crystal driving means at said second scanning.

10. The liquid crystal display unit as set forth in claim 8, wherein said two polarizing plates are disposed such that a direction of molecular major axes of liquid crystal molecules is substantially coincident with either of axes of polarization of said two polarizing plates in the case when an electric field is applied to the respective pixels of said liquid crystal panel in said second scanning.

11. The liquid crystal display unit as set forth in claim 8, wherein said liquid crystal driving control means controls a polarity of an applied electric field such that a direction of molecular major axes of liquid crystal molecules is substantially coincident with either of polarizing axes of said two polarizing plates in the case when the electric field is applied to the respective pixels of said liquid crystal panel in said second scanning.

12. The liquid crystal display unit as set forth in claim 8, wherein the light-emitting region of said back light is divided into at least two, and said light source is divided in response to the respective divided light-emitting regions of said back light.

13. The liquid crystal display unit as set forth in claim 12, further comprising means for controlling light emission of said back light such that respective sections of said divided light-emitting regions of said back light assume a light-emitting condition or a nonemitting condition in synchronism with scanning of the respective pixels in a section corresponding to said liquid crystal panel.

14. The liquid crystal display unit as set forth in claim 12, further comprising means for controlling light emission of said back light such that respective sections of said divided light-emitting regions of said back light assume a light-emitting condition during only a period wherein selected ones of said pixels in a corresponding section of said liquid crystal panel are in a display state.

15. The display control method according to claim 1, wherein image data supplied from said first scanning to said respective ones of said pixels is passed through an inverted data generating circuit and supplied in said second scanning to same respective ones of said pixels.

* * * * *